US008715097B2

(12) United States Patent
Knafel

(10) Patent No.: US 8,715,097 B2
(45) Date of Patent: May 6, 2014

(54) GOLF CLUB HEAD

(76) Inventor: Irwin A. Knafel, Higganum, CT (US)

( * ) Notice: Subject to any disclaimer, the term of this patent is extended or adjusted under 35 U.S.C. 154(b) by 142 days.

(21) Appl. No.: 12/958,621

(22) Filed: Dec. 2, 2010

(65) Prior Publication Data

US 2012/0142448 A1 Jun. 7, 2012

(51) Int. Cl.
*A63B 69/36* (2006.01)

(52) U.S. Cl.
USPC ..... 473/221; 473/223; 473/226; 473/236; 473/238; 473/242

(58) Field of Classification Search
CPC ..... A63B 53/007; A63B 53/065; A63B 59/0092; A63B 2053/0445; A63B 3/0487; A63B 69/3685
USPC ..... 473/236, 342, 340, 341, 349, 332, 329
See application file for complete search history.

(56) References Cited

U.S. PATENT DOCUMENTS

| | | | | |
|---|---|---|---|---|
| 3,194,564 | A * | 7/1965 | Swan | 473/236 |
| 3,384,376 | A * | 5/1968 | Greenlee | 473/236 |
| 3,692,306 | A | 9/1972 | Glover | |
| 3,730,529 | A * | 5/1973 | Donofrio | 473/237 |
| 4,156,526 | A * | 5/1979 | Huggins et al. | 473/329 |
| 4,398,965 | A | 8/1983 | Campau | |
| 4,422,638 | A * | 12/1983 | Tucker | 473/329 |
| 5,135,229 | A * | 8/1992 | Archer | 473/236 |
| 5,240,253 | A * | 8/1993 | Cooper | 473/236 |
| 5,332,214 | A * | 7/1994 | Tucker, Sr. | 473/329 |
| 5,551,695 | A * | 9/1996 | Wolk | 473/236 |
| 5,709,611 | A * | 1/1998 | Intag | 473/236 |
| 6,110,057 | A * | 8/2000 | McKinnon | 473/313 |
| 6,220,971 | B1 | 4/2001 | Takeda | |
| 6,261,192 | B1 * | 7/2001 | Otani | 473/324 |
| 6,270,423 | B1 * | 8/2001 | Webb | 473/226 |
| 6,273,827 | B1 * | 8/2001 | Hockerson et al. | 473/236 |
| 6,663,503 | B1 | 12/2003 | Kenmi | |
| 7,104,898 | B1 * | 9/2006 | Caserta | 473/236 |
| 7,311,612 | B2 * | 12/2007 | DeLucia | 473/237 |
| 7,322,891 | B1 * | 1/2008 | Prewitt | 473/236 |
| 7,338,388 | B2 | 3/2008 | Schweigert et al. | |
| 7,584,531 | B2 | 9/2009 | Schweigert et al. | |
| 7,614,960 | B2 * | 11/2009 | Miller et al. | 473/236 |
| 7,614,964 | B2 | 11/2009 | Matsunaga | |
| 2002/0193173 | A1 | 12/2002 | Sherwood | |
| 2004/0147332 | A1 * | 7/2004 | Engdahl | 473/236 |
| 2004/0192460 | A1 | 9/2004 | Sherwood | |
| 2006/0063606 | A1 | 3/2006 | Schweigert et al. | |
| 2008/0125246 | A1 | 5/2008 | Matsunaga | |
| 2010/0087270 | A1 | 4/2010 | Ban et al. | |

* cited by examiner

*Primary Examiner* — Sebastiano Passaniti
(74) *Attorney, Agent, or Firm* — DeLio, Peterson & Curcio, LLC; Peter W. Peterson

(57) ABSTRACT

A golf club head is provided and includes a club head body, a club head face connected to a front portion of the club head body, wherein the club head face includes a club face surface having a plurality of face cavities arranged across the club face surface and a plurality of protrusion posts, wherein each of the plurality of protrusion posts includes a post body having a post base and a post head, wherein the plurality of protrusion posts is associated with the club face to extend away from the club face surface such that the post base of each of the plurality posts is located in separate cavities of the plurality of face cavities.

16 Claims, 13 Drawing Sheets

GOLF CLUB HEAD

FIELD OF THE INVENTION

The present invention relates to a golf club head and more particularly to an improved golf club head having a face with a plurality of protrusions.

BACKGROUND OF THE INVENTION

As the popularity of Golf has increased among non-professional players in recent years, so too has the variability in the skill level and ages of the players. As such, players of all ages and skill levels can typically be found on golf courses across the world. Women and children are particularly disadvantaged by the strength requirements of competitive golf play against adult males. As is known, golf is a difficult game that requires practice and frequent play to develop the strength, flexibility and skill to play well. Unfortunately, most people do not have the resources to spend a sufficient amount of time practicing and playing to develop this skill. Accordingly, to make the game more satisfying and less frustrating players are always looking for a way to enhance their skills as quickly and easily as possible. As may be expected businesses that manufacture and sell golfing equipment, such as golf clubs and golf balls, have taken notice of this increase in popularity and desire to play well and have taken steps to capitalize on this trend.

One such step involves the technological advancements to golf equipment that increases the performance of the golfer, such as the development of improved golf club shafts, grips and heads that enhance the overall characteristics and performance of the golf club. For example, one such technological advancement involves golf balls that are specially configured to go farther, higher or that are 'softer' to give the player more control and backspin. In fact, golf ball technology has advanced so much that golf balls are typically divided into two categories: recreational and advanced balls. Another such technological advancement involves the golf clubs themselves. For example, "woods" (such as a driver) are long distance clubs that are meant to drive the golf ball a great distance towards the green. Typically, these clubs have a large head and long shaft to achieve the maximum club head speed and may be made from wood, metal, composite materials or a combination of these materials. Club head speed is one significant factor in achieving the maximum distance of the golf ball because of the transference of energy from the golf club head to the ball. For example, professional golfers can achieve consistent club head speeds of over 100 miles per hour. In fact, the interaction between the club head and ball typically determines how far the ball will travel. However, not every player is able to achieve these speeds and average players typically have an average club head speed of about 85 miles per hour.

Another factor which is significant in achieving the maximum distance of the golf ball is compression of the ball. When the club face strikes the ball, the ball experiences a compression and deformation by the force of impact of the club face on the ball and the relationship between speed of the club head and the initial velocity of the ball is dependent upon a "coefficient of restitution" of the ball which is typically a measurement of the ability of the club face to rebound the ball. At the point of impact between the club head and the ball, kinetic energy is transferred to and stored by the ball as the ball attempts to regain its shape.

As such, a number of clubs are typically designed to take advantage of the coefficient of restitution of the ball to help these players achieve longer distances while still hitting the golf ball at average club head speeds. One type of club head design includes face plates that resiliently store energy (See U.S. Pat. No. 4,398,965) such that when the club face hits the ball, energy is stored in the club head and transferred back to the ball when the ball leaves the club face. Other types of club head designs include weight inserts to give the club head more momentum during the swing and a more solid striking surface when hitting the ball. Unfortunately however, current club face designs are not able to efficiently control compression of the ball at the point of impact between the club head and the ball.

SUMMARY OF THE INVENTION

One embodiment of a golf club head is provided and includes a club head body, a club head face connected to a front portion of the club head body, wherein the club head face includes a club face surface having a plurality of face cavities arranged across the club face surface and a plurality of protrusion posts, wherein each of the plurality of protrusion posts includes a post body having a post base and a post head, wherein the plurality of protrusion posts is associated with the club face to extend away from the club face surface such that the post base of each of the plurality posts is located in separate cavities of the plurality of face cavities.

A golf club head having a club head body is provided and includes a club head face associated with a front portion of the club head body, wherein the club head face includes a plurality of protrusions extending out of and away from the surface of the club head face.

A golf club putter is provided and includes a putter head body having a putter face and a putter face portion associated with the putter face to cover at least a portion of the putter face. The putter face portion is constructed from an energy absorbing material such that when the putter face portion contacts a golf ball, a portion of the energy transferred between the golf ball and the putter face portion is absorbed by the putter face portion.

DETAILED DESCRIPTION OF THE INVENTION

In accordance with the present invention as discussed hereinafter, a golf club head that includes an improved golf club face design configured to propel a golf ball further than current conventional golf club head designs allow while providing better control of the golf ball is provided and disclosed herein. It should be appreciated that the improved golf club face design includes a club face surface having a plurality of protrusions that, upon impact with the golf ball, causes a greater penetration of the ball to enhance flexing of the ball (i.e. compression) which allows the golf ball to be propelled to a greater distance than conventional clubs. Accordingly, overall compression of the ball may be increased thus allowing for better rebound effect. Moreover, because the protrusions may have multiple shapes and may be arranged in multiple patterns on the golf club face, control of the ball can be adjusted as desired. For example, a pattern of protrusions that form a slightly concaved surface design might be used to correct for hooks or slices, while a pattern of protrusions that form a slightly convex surface design might sacrifice some control but allow for greater distances. It should be appreciated that although the improved golf club face is discussed herein as being the face of a driver (i.e. wood), it is contemplated that the improved golf club face may be utilized with any golf club face as desired, such as with club irons.

Figure 1A:
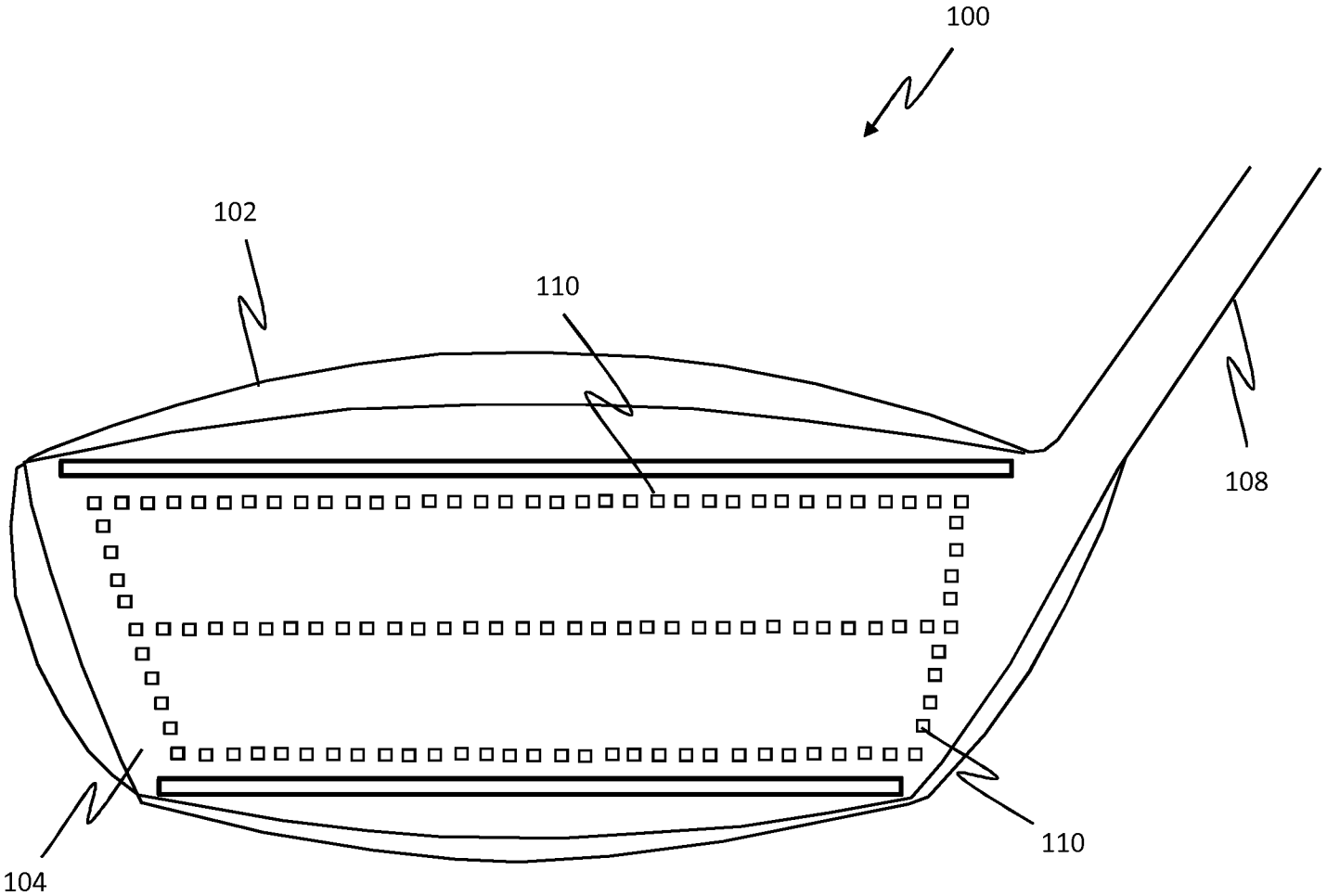
FIG. 1*a* is a front view of a golf club head showing the golf club face, in accordance with one embodiment of the present invention.
Figure 1B:
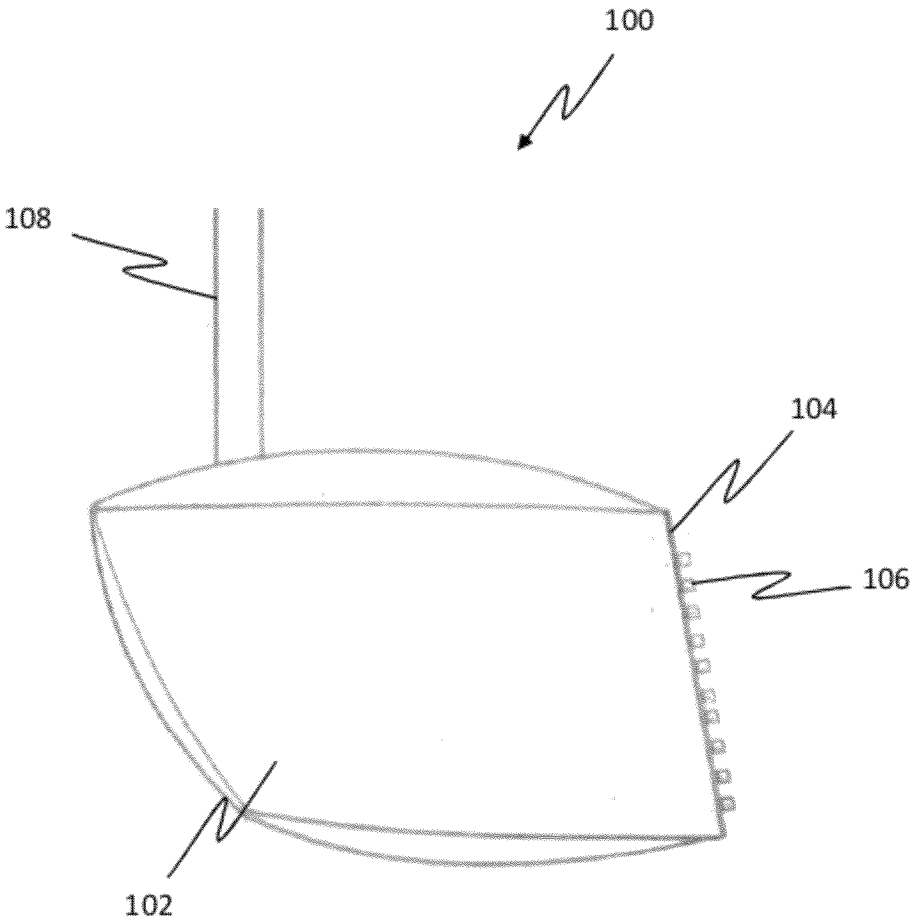
FIG. 1*b* is a side view of the golf club head of FIG. 1.
Figure 2:
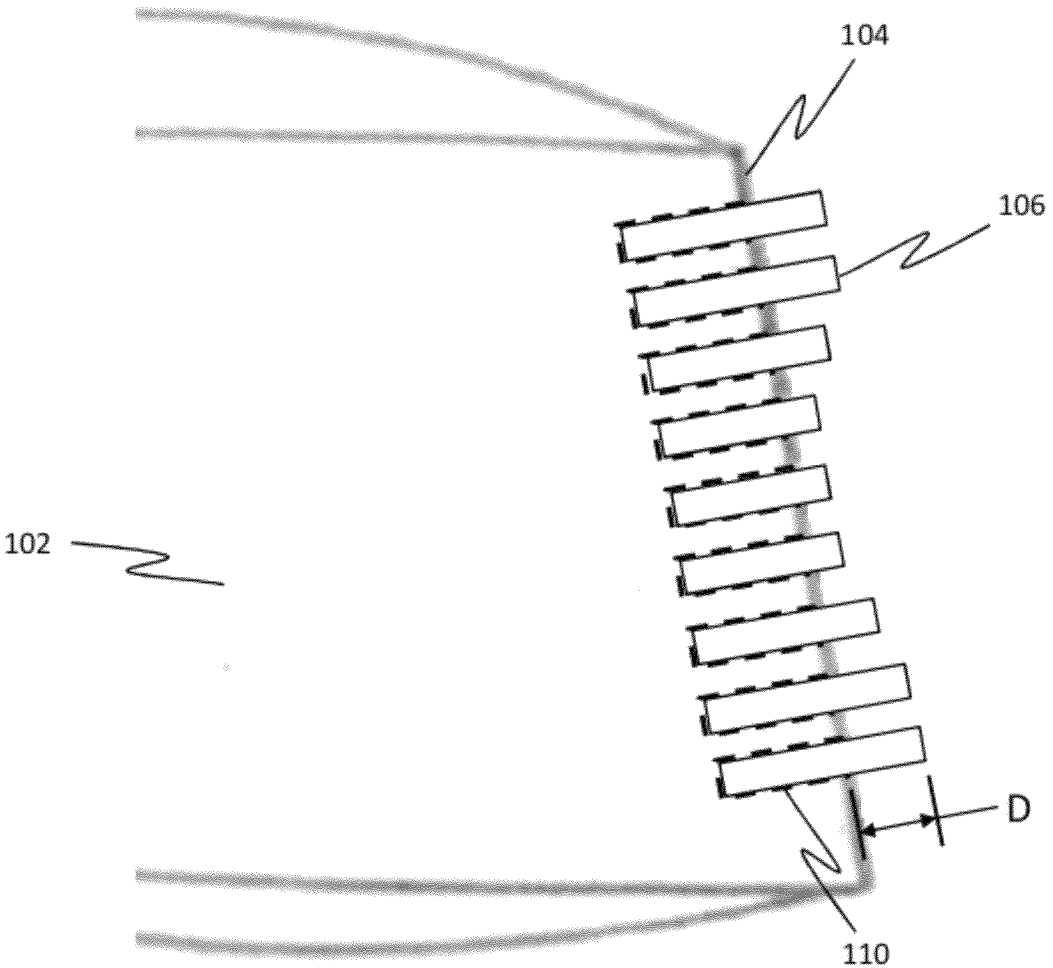
FIG. 2 is a side sectional view of the golf club head of FIG. 1 showing the posts protruding from the golf club face.

Referring to FIG. 1*a* and FIG. 1*b*, one embodiment of a golf club head 100 is shown and includes a club head body 102 and a club head face 104, where the golf club head 100 includes a plurality of posts 106 that are arranged in a pattern on the club head face 104 and that extend out of the club head face 104. As shown, each of the plurality of posts 106 may be securely associated with the club head face 104 to extend out of the club head face 104 in a substantially perpendicular fashion. It should also be appreciated that, if desired, each (or only some) of the plurality of posts 106 may extend from the club head face 104 in a non-perpendicular fashion. Additionally, the golf club head 100 may be attached to a golf club shaft 108. It should be appreciated the plurality of posts 106 may be arranged on the golf club face 104 to achieve a desired effect. For example, the plurality of posts 106 may be arranged such that the posts 106 closest to the side of the golf club face 104 extend farther from the golf club face 104 than the posts located in the middle area of the golf club face 104, as shown in FIG. 2. Furthermore, it should be appreciated that the posts 106 (or only some of the posts 106) may be located close to each other or may be spaced apart from each other to act as discrete elements when contacting the golf ball.

Figure 3A:
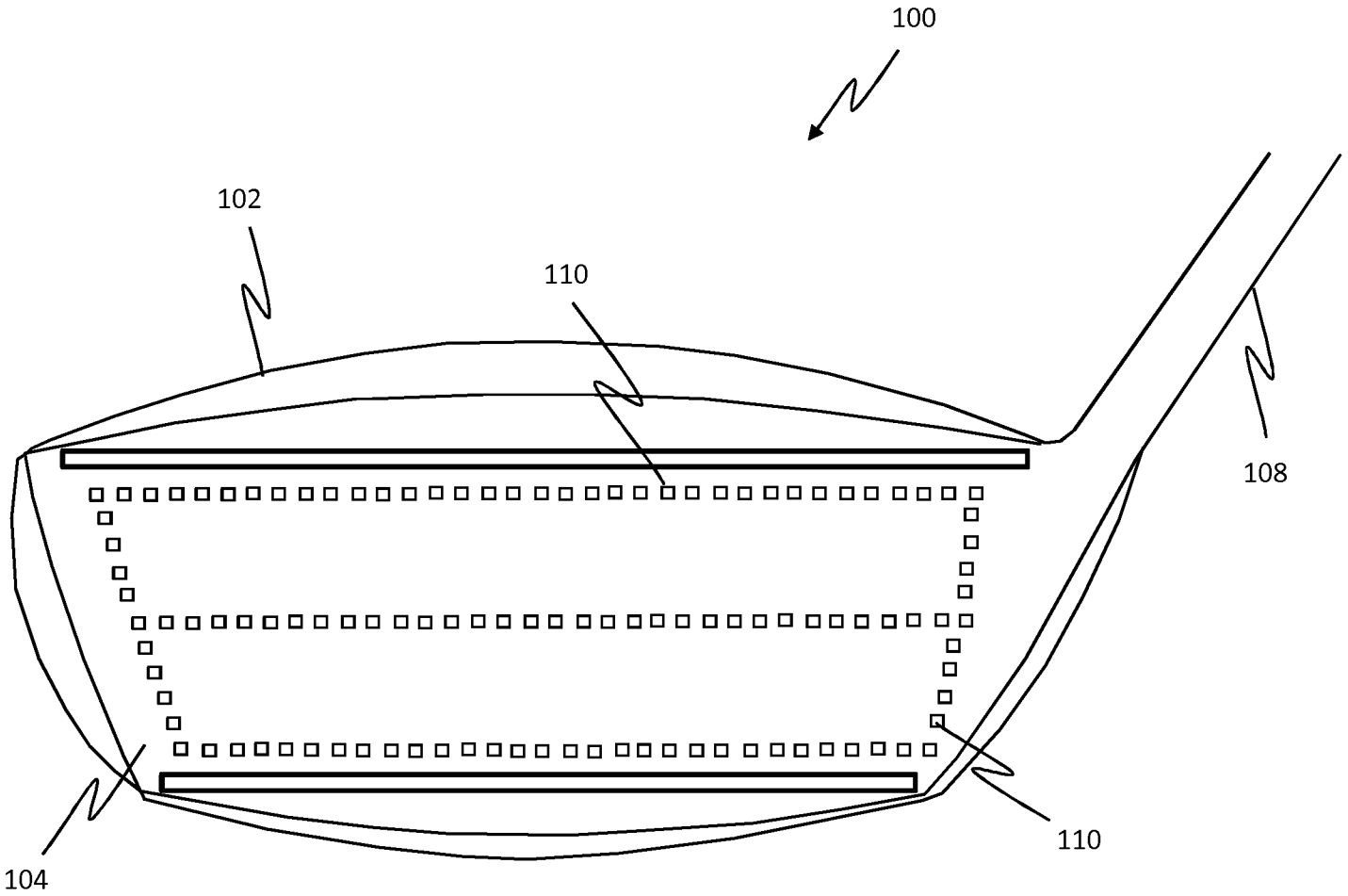
FIG. 3*a* is a front view of the golf club head of FIG. 1 showing the cavities in the golf club face, in accordance with one embodiment of the present invention.
Figure 3B:
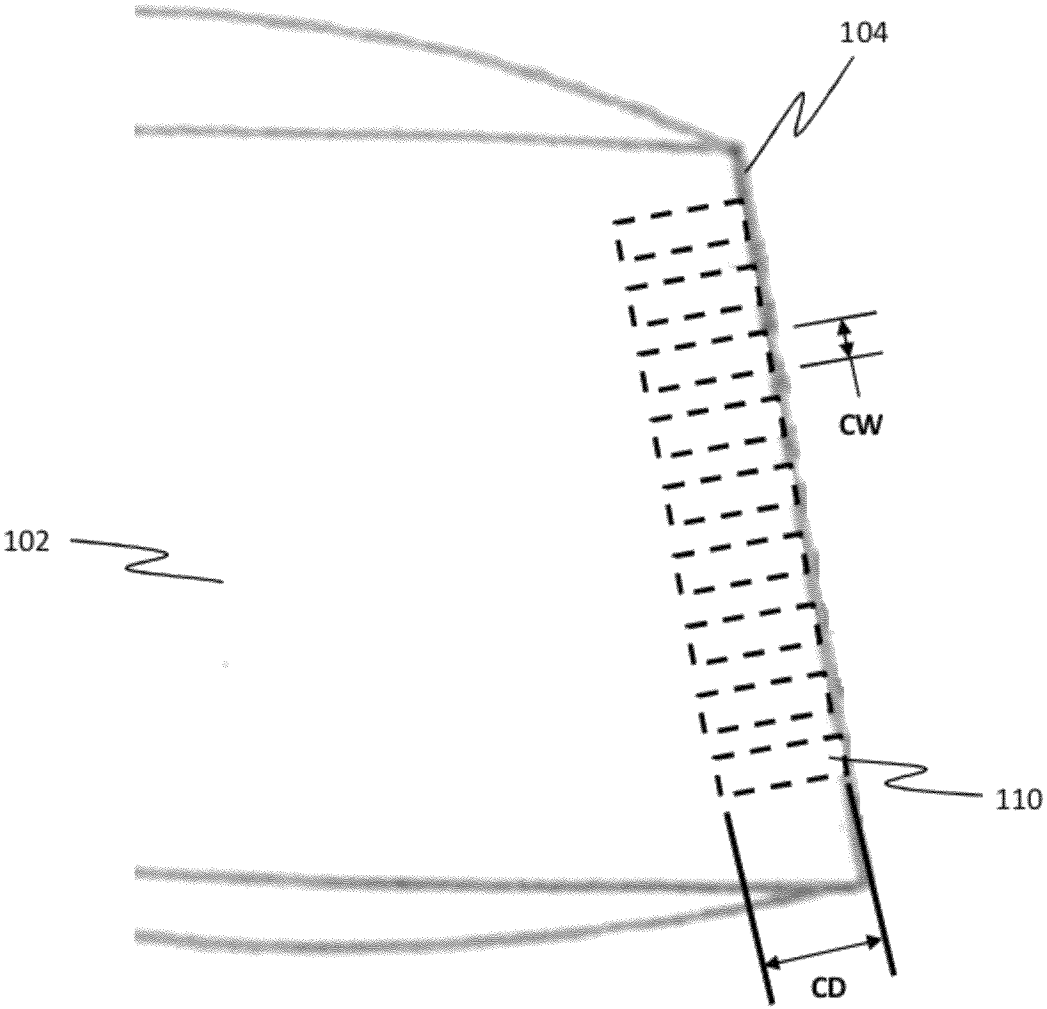
FIG. 3*b* is a side sectional view of the golf club head of FIG. 3*a* showing the cavities in the golf club face.

In accordance with the invention, the plurality of posts 106 may be associated with the club head face 104 via a plurality of cavities 110 (or post holes) which extend into the club head face 104 (and/or club head body 102), as shown in FIG. 3*a* and FIG. 3*b*. The plurality of cavities 110 includes a cavity width CW (or diameter if circular) and a cavity depth CD. As discussed below, each of the plurality of cavities 110 may be configured to receive and contain a portion of the post 106. When the plurality of posts 106 are located in the plurality of cavities 110, the plurality of posts 106 may be securely associated in the plurality of cavities 110 via a friction fit, an epoxy, a weld and/or any combination thereof.

Figure 4A:
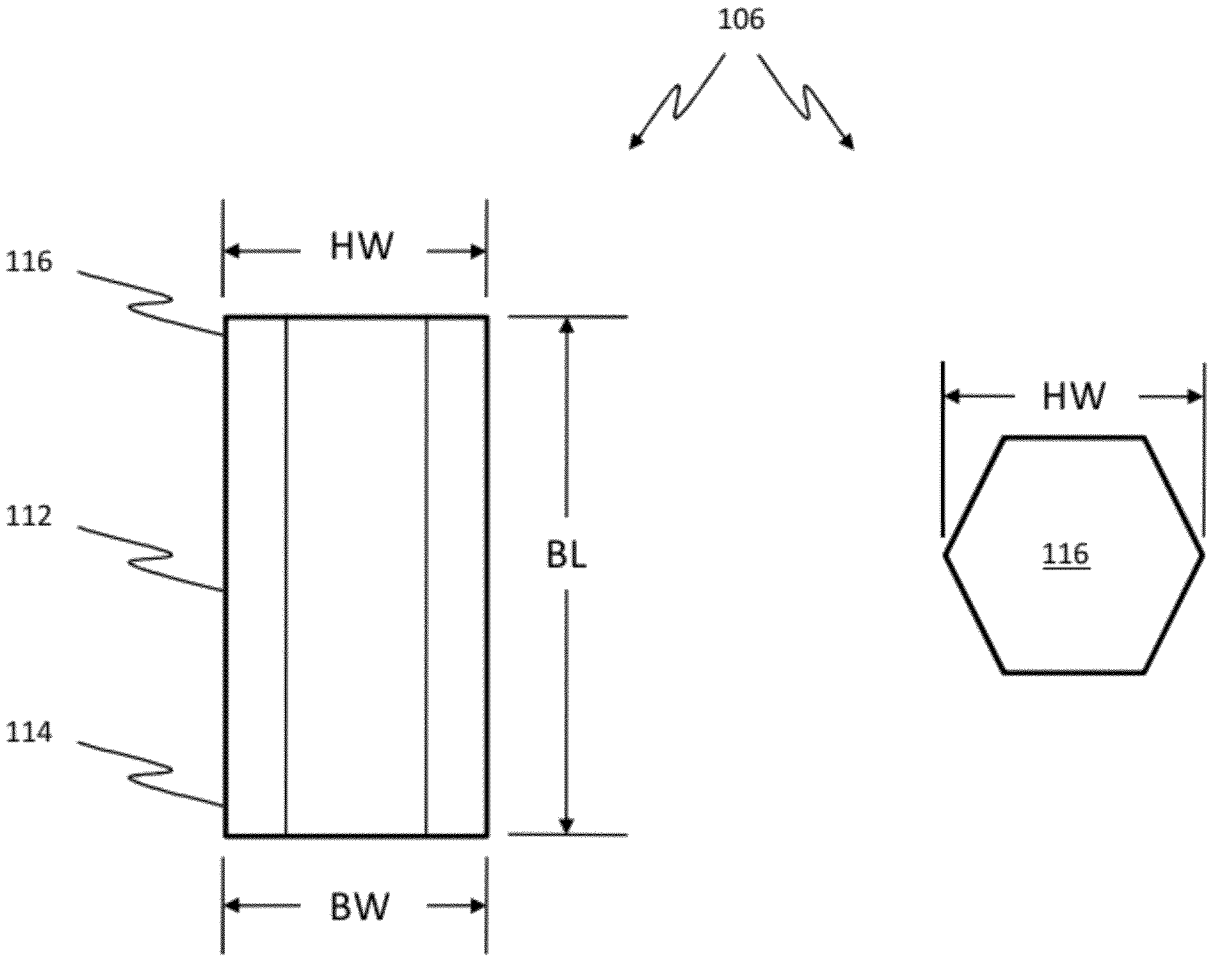
FIG. 4*a* is a side view and a top down view of a post, in accordance with the present invention.
Figure 4B:
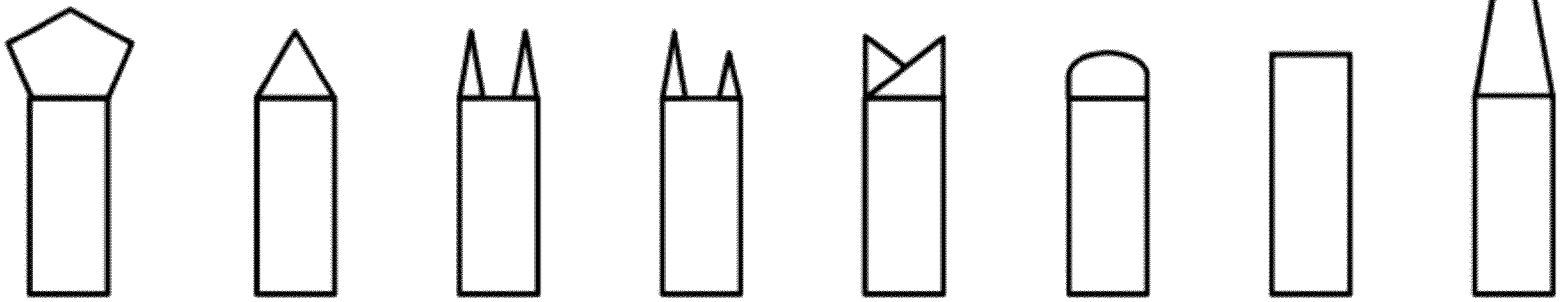
FIG. 4*b* is a side view of a plurality of posts having different shapes, in accordance with the present invention.
Figure 4C:
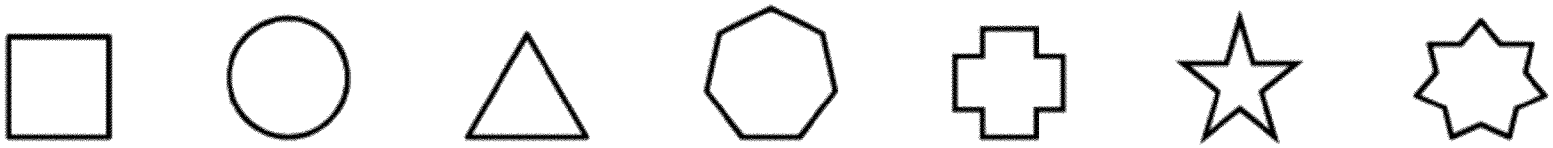
FIG. 4*c* is a top down view of a plurality of posts having different shapes, in accordance with the present invention
Figure 4D:
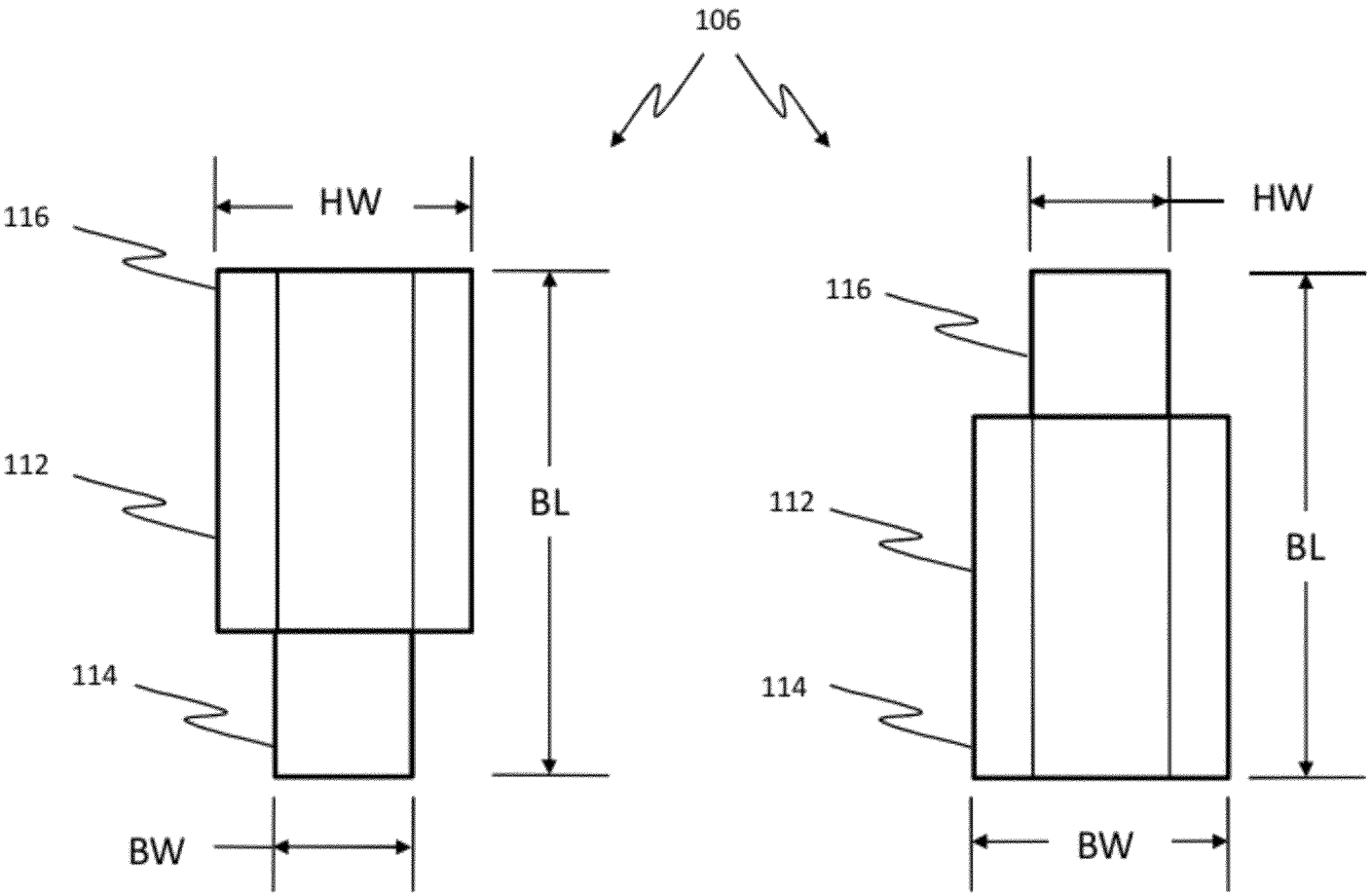
FIG. 4*d* is a side view of a post having a post base that is smaller than the post head and a post having a post base that is larger than the post head, in accordance with various embodiments of the present invention.
Figure 4E:
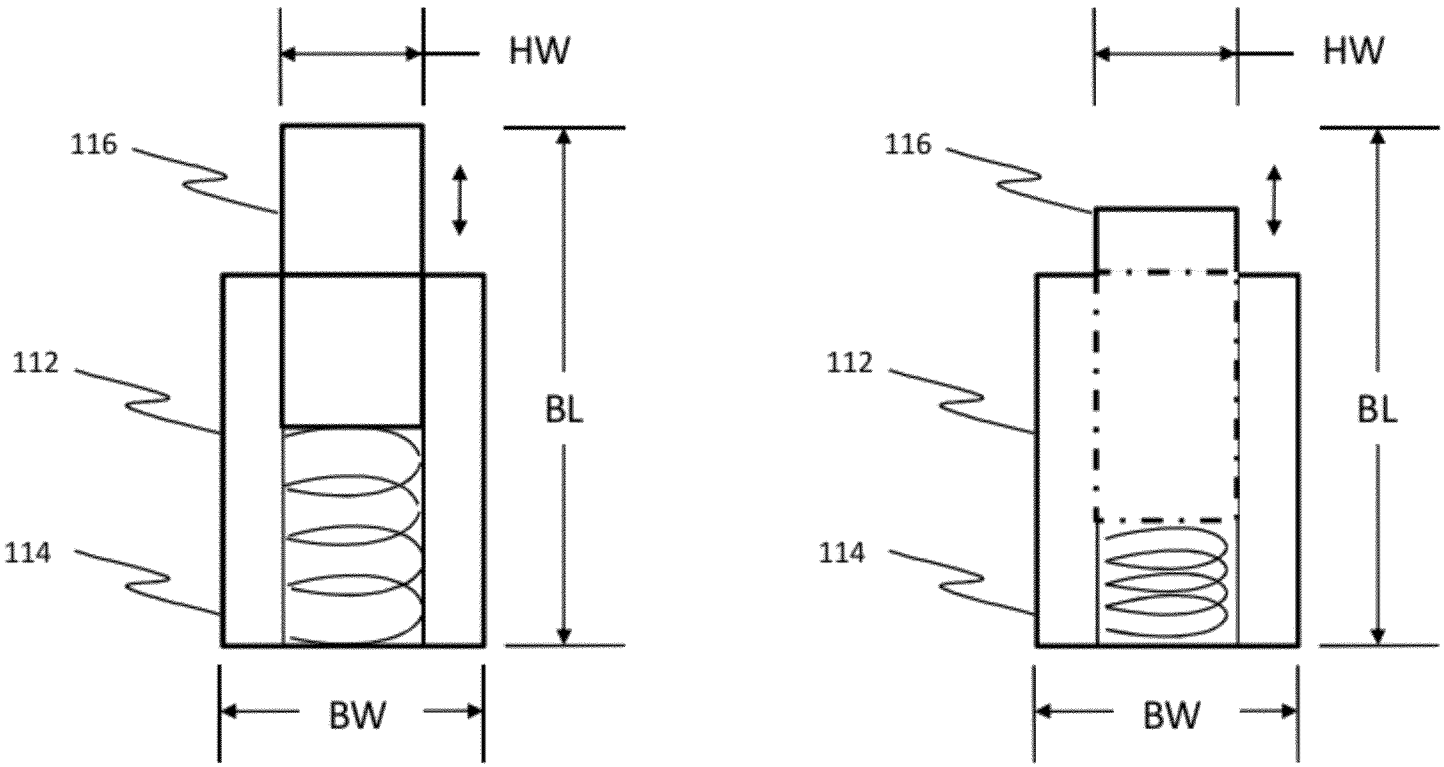
FIG. 4*e* is a side view of another embodiment of a post having a moveable post heat and a resilient member within the post.

Referring to FIG. 4*a*, one embodiment of a post 106 is shown and includes a post body 112 having a post base 114 and a post head 116. It should be appreciated that the post base 114 and/or the post head 116 may be of any shape suitable to the desired end purpose, such as round, square, single-pointed, multi-pointed, wedge shaped, star shaped, triangular shaped, etc. FIG. 4*b* and FIG. 4*c* show some examples of shapes that may be used. In accordance with the invention, the post base 114 includes a base width BW (or diameter if the post base 114 is circular), the post head includes a head width HW (or diameter if the post head 116 is circular) and the post body 112 includes a body length BL. It should be appreciated that although the base width BW of the post 106 is shown in FIG. 4*a* as being the substantially the same size as the head width HW of the post 106, configurations where the base width BW of the post 106 is larger or smaller than the head width HW of the post 106 are contemplated. Some examples of these configurations are shown in FIG. 4*d*. It is also contemplated that in other embodiments, the posts 106 (or protrusions) may include a hollow post 106 (or protrusion) or a resilient device 106 (such as spring) contained within to assist with the transfer of energy between the post 106 (or protrusion) and the ball. One embodiment of such a post 106 is shown in FIG. 4*e*. In this case, the post head 116 may resiliently compress relative to the post 106 such that the body length BL decreases upon impact and returns to normal during rebound.

Figure 5:
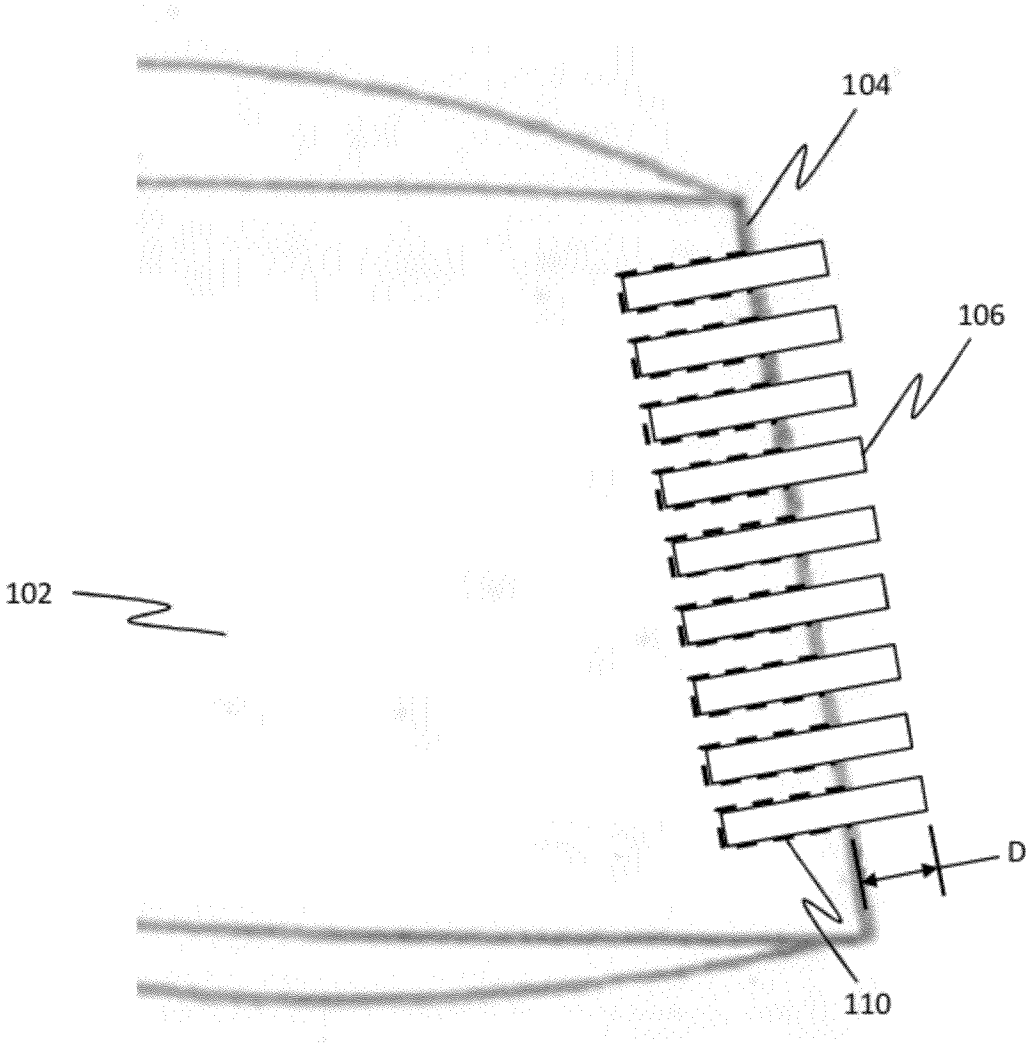
FIG. 5 is a side sectional view of the golf club head of FIG. 1 showing the posts protruding from the golf club face.

In accordance with the invention, the cavity width CW of the club face 104 may be sized relative to the base width BW of the post 106 such that the post base 114 fits snugly within the cavity 110. Additionally, the body length BL of the post body 112 may be sized relative to the cavity depth CD of the cavity 110 such that when the post 106 is located within the cavity 110 the post 106 extends a distance D from the club head face 104. This is illustrated in FIG. 5. As discussed briefly hereinbefore, the distance D for each post may be adjusted on an individual basis to achieve a desired shape of the club head face 104. This may be accomplished by using posts 106 having different body lengths BL or by cavities 110 having different cavity depths CD. Additionally, it is contemplated that in some embodiments, the post body 112 may extend into the club head as far back as desired, such as to the back of the club head. Furthermore, the posts 106 (or protrusions) may be constructed from any material or combination of materials suitable to the desired end purpose, such as metal, plastic, ceramic, composite (hard and/or soft, for example such as neoprene) or any combination thereof.

Figure 6:
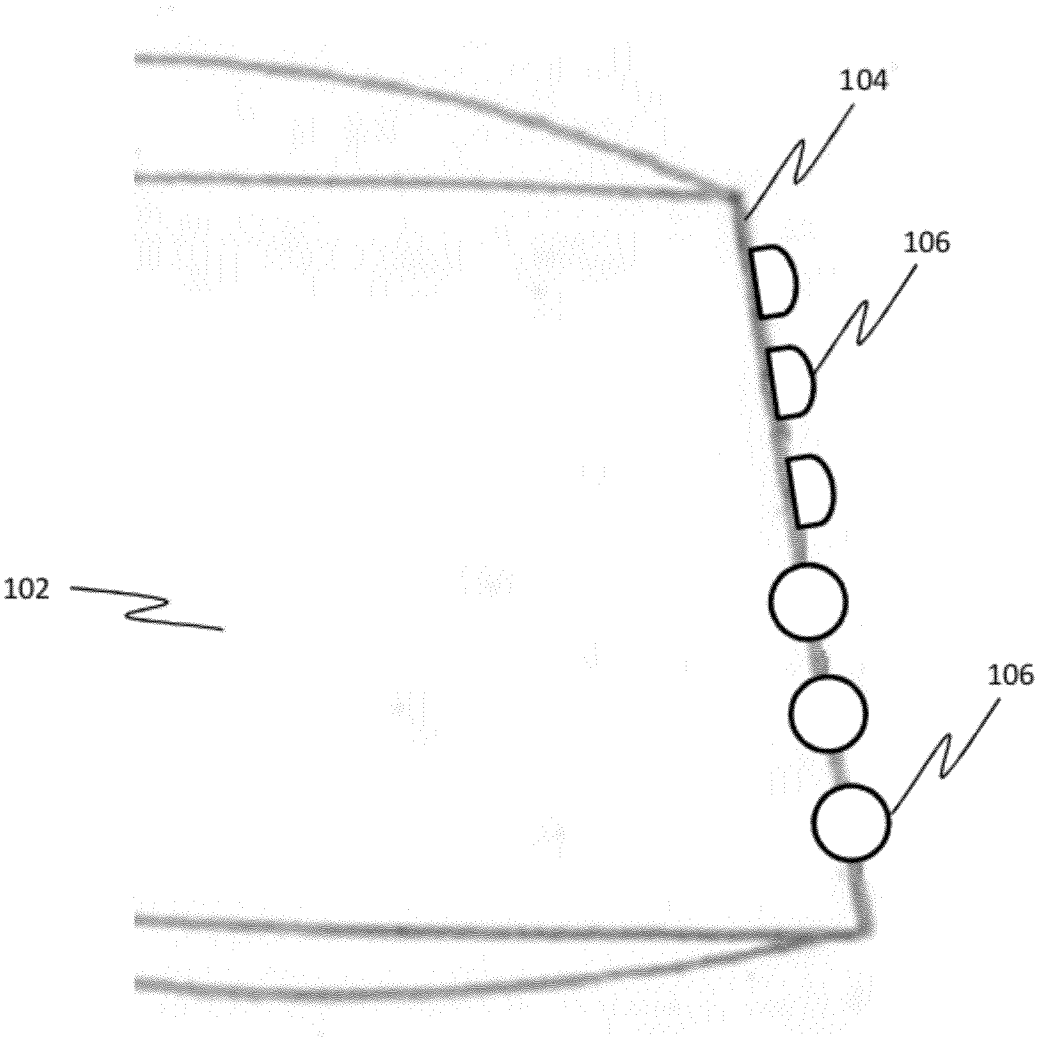
FIG. 6 is a side sectional view of the golf club head of FIG. 1 showing different embodiments of the protrusions extending from the golf club face.

It should be appreciated that although the posts 106 are shown as being associated with the golf club face 104 by disposing the post base 114 in side of the cavity 110 in the golf club face 104, it is contemplated that other methods of securely associating the posts 106 with the golf club face 104 may be used. For example, the posts 106 may be directly affixed to the golf club face 104 using an epoxy material. Furthermore, it is contemplated that the protrusions 106 may be formed using other devices or methods other than posts, such as a ridge that extends across the surface (at least partially) of the golf club face 104, an arrangement of cylinders (tubes—hollow or solid) or a semi-circular protrusion (i.e. ½ of a ball having a flat surface that is adhered to the golf club face 104) as shown in FIG. 6. As such, the protrusions may be formed from continuous quadrilateral bars, cylinders, or other geometric shapes that are set within the golf club face 104 and may be arranged in horizontal and/or vertical patterns, concentric circles/ovals, wave patterns, etc. Additionally, ball arrangements may be used where balls of various materials (metal, ceramics, etc) and of various sizes may be inset or embedded into the golf club face 104 where they may be movable or stationary. The protrusions may be configured as three-dimensional geometric shapes (such as for example trapezoids, boxes, cylinders) and may be hollow, solid or semi-solid.

Moreover, it should be appreciated that the posts (or protrusions) may be formed as an integral feature of the club face (or club head) and/or the posts (or protrusions) may be a feature added to the club face. For example, in one embodiment, during the manufacturing of the golf club head, the face plate may include protrusions or posts that are formed (such as by stamping or forging) into the metal face plate. While in another embodiment the protrusions or posts may be added to the face plate by affixing or otherwise connecting (such as for example via threaded interfaces) the posts or protrusions to the face plate. In embodiments that have a post 106 (or protrusion) that are not integral with the face plate (or club head), the posts 106 may be securely associated with the face plate (or club head) via any method or device suitable to the desired end purpose, such as an epoxy, a threaded connection and a friction (i.e. snug or snap fit). In this case the posts 106 (or protrusions) may be replaceable. It is also contemplated that the golf head (or face plate) may include sensors to sense or monitor characteristics of the impact with the ball or the players swing. In one embodiment, the protrusions or posts may be associated with the sensors to identify the impact or force the ball and to identify which posts or protrusions are being contacted during impact. The data generated by the sensors may be stored in a via a storage device integral with the club head (or other part of the club, such as the shaft) or the data may be transmitted via a hard wired or wireless connection with a processing and/or storage device.

Figure 7:
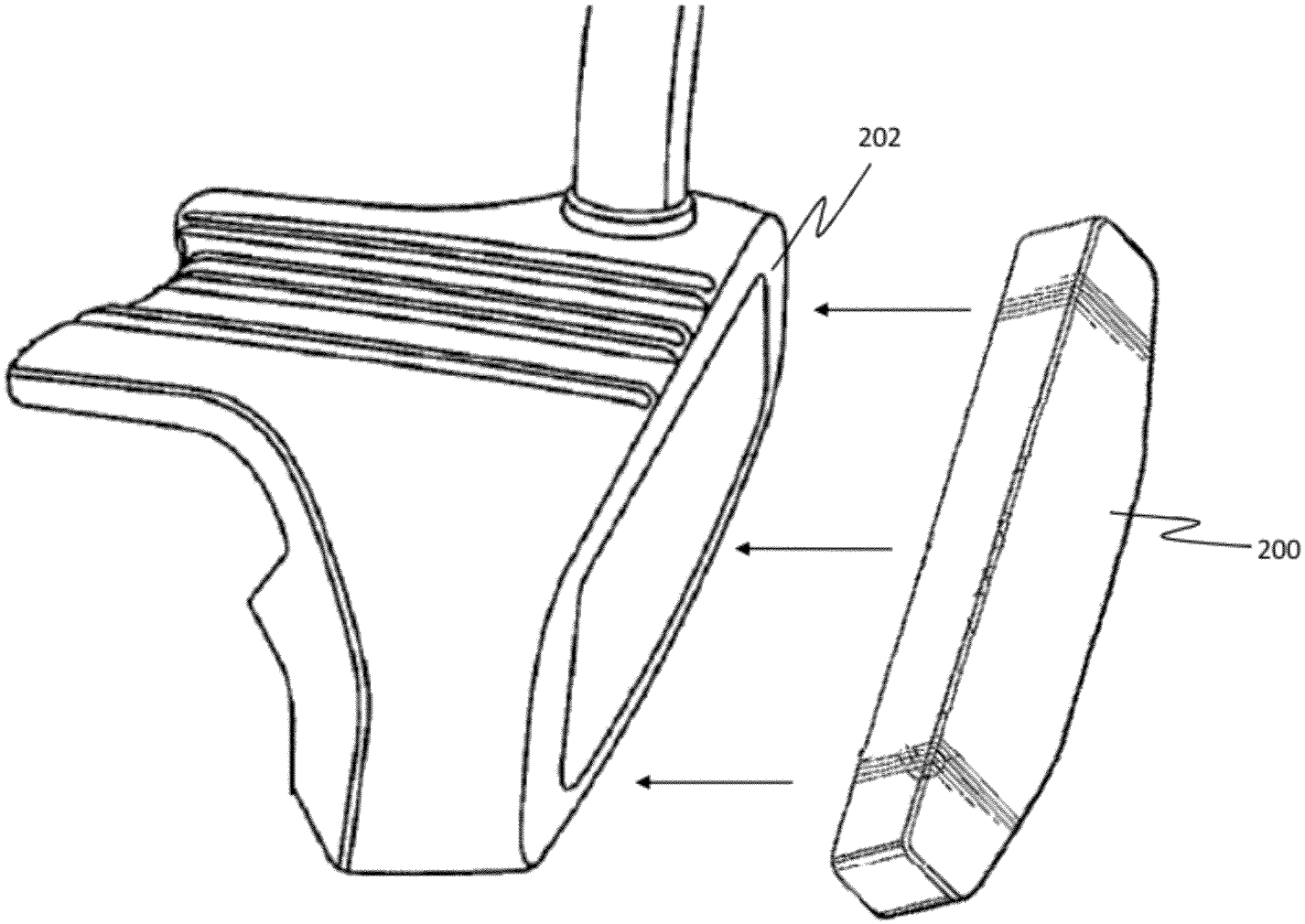
FIG. 7 is a side sectional view of a golf putter head showing a putter face portion associated with the golf putter head, in accordance with an additional embodiment of the invention.

In accordance with an additional embodiment, as shown in FIG. 7 a putter face portion 200 is provided where the putter face portion 200 may be securely and/or removably associated (or may be a permanent and/or integral feature) with the face of a putter 202. It is contemplated that the putter face portion 200 may be a non-removable integral part of the putter head (i.e. built into the putter head during the manufacturing process) or the putter face portion 200 may be removably secured to the face of a putter via any securing device or method suitable to the desired end purpose, such as epoxy, Velcro®, screws, clips, snaps and/or a friction device that fits over the putter face like a glove or cover. The putter face portion 200 includes a front surface 202 which is positioned to engage with the golf ball during putting and may be constructed from a relatively soft material to absorb the impact with the golf ball. Accordingly, the front surface 202 of the putter portion 200 may be constructed from a felt material, a rubber material and/or a dense brush type of material. One benefit of using an energy absorbing material on the face of the putter is to reduce the coefficient of restitution to enhance the golfer's control of the putt. For example, a player using a normal putter hitting a ball with two ft-lbs of force may propel a ball 10 feet on a putting green, whereas a player using a putter having the face portion 200 of the present invention hitting the ball with two ft-lbs of force may propel a ball only 7 feet.

Figure 8:
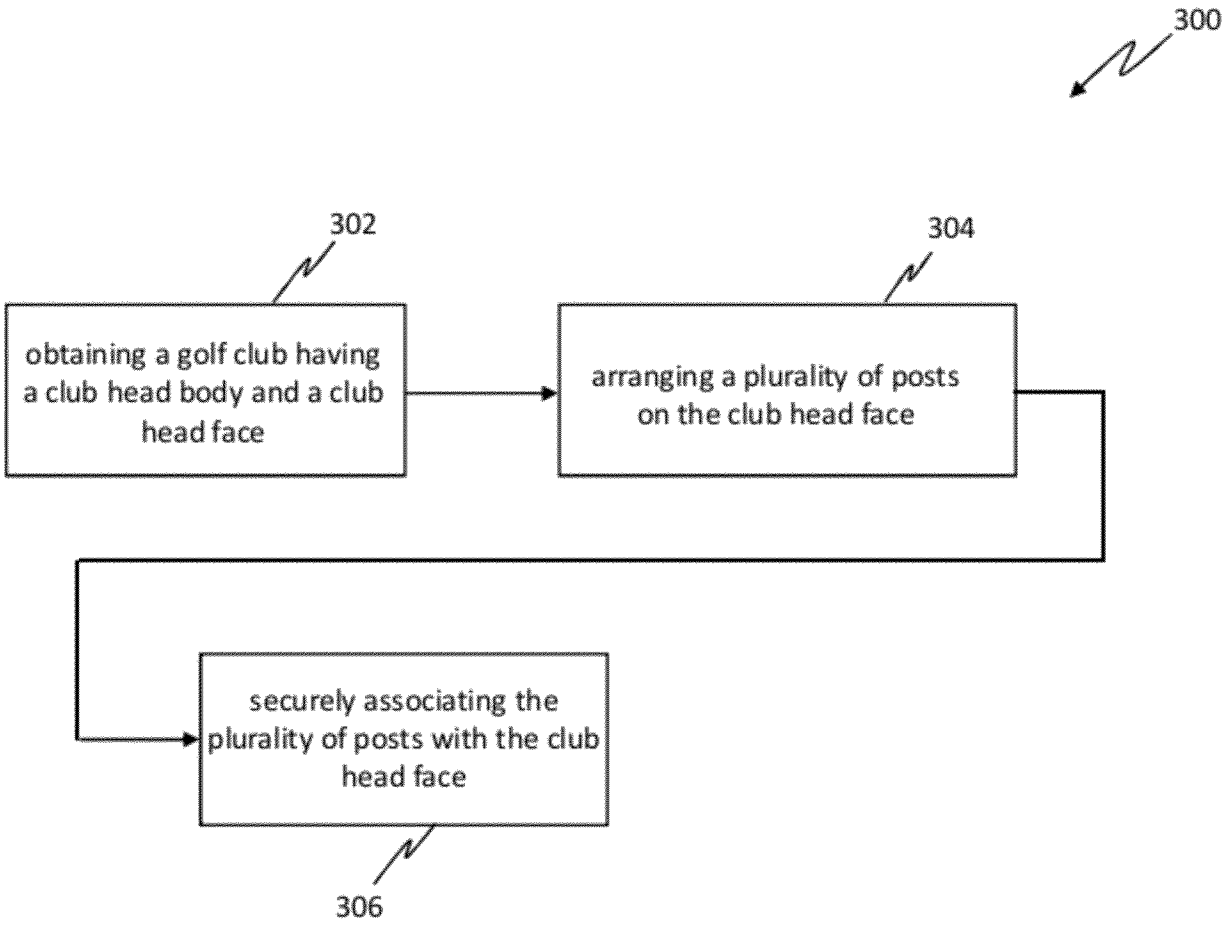
FIG. 8 is an operational block diagram illustrating a method for fabricating the golf club head of FIG. 1 having an improved golf club face, in accordance with the present invention.

Referring to FIG. 8, an operational block diagram 300 illustrating a method for fabricating the golf club head 100 having a club head body and an improved club head face is illustrated and includes obtaining a golf club head having a club head body and a club head face, as shown in operational block 302. It should be appreciated that for the embodiment where the posts 106 are integral to the club head, this step may include forming and/or creating a golf club head. A plurality of posts 106 are arranged on the club head face responsive to a desired result, as shown in operational block 304. The plurality of posts 106 are then securely associated with the club head face, as described hereinabove and as shown in operational block 306. It should be appreciated that for the embodiment where the posts 106 are integral to the club head, this step may include forming the posts integral with the golf club head, such as via the face plate. It should be appreciated that the method of FIG. 8 may be implemented with the putter face portion 200 of FIG. 7 as well. In accordance with the present invention, the processing of the method 300 in FIG. 8 may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt(s), communication interface (s), and input/output signal interface(s), as well as combination comprising at least one of the foregoing.

Moreover, the method of the present invention may be embodied in the form of a computer or controller implemented processes. The method of the invention may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the invention. The invention can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A golf club head, comprising:

a club head body; and a club head face associated with a front portion of the club head body, wherein the club head face includes in the central, ball-striking portion thereof a plurality of cavities extending partially into the club head body, with each of the cavities terminating within the club head body;

wherein the club head face includes in the central, ball-striking portion thereof a plurality of protrusion posts and each of the plurality of protrusion posts includes a post body having a post base and a post head, wherein the plurality of protrusion posts is associated with the club head face to extend away from the surface of the club head face such that the post base of each of the plurality posts is associated with separate cavities of the plurality of cavities, at least some of the protrusion posts extending in a non-perpendicular fashion with respect to the surface of the club head face, the plurality of protrusion posts being spaced sufficiently close to each other to make contact with and impact a golf ball when the central portion of the club face strikes the ball.

2. The golf club head of claim 1, wherein the post base includes a base width BW and the face cavity includes a cavity width CW and wherein the base width BW and the cavity CW are sized to allow the post base to fit snugly within the face cavity.

3. The golf club head of claim 1, wherein the post base includes a base width BW and the post head includes a head width HW and wherein the base width BW and the head width HW are substantially equal.

4. The golf club head of claim 1, wherein the post head is configured in at least one of a round shape, square shape, a single pointed shape, a multi-pointed shape, a wedge shape, a star shape and a triangular shape.

5. The golf club head of claim 1, wherein the plurality of protrusion posts are securely associated with the club face via at least one of a friction fit, a weld or an epoxy.

6. The golf club head of claim 1, further comprising at least one sensing device associated with at least one of the plurality of protrusion posts.

7. The golf club head of claim 1, wherein the plurality of posts are associated with the plurality of cavities via at least one of a threaded connection, an epoxy and a friction/snap fit connection.

8. The golf club head of claim 7, wherein the plurality of posts are removably associated with the plurality of cavities.

9. The golf club head of claim 7, wherein the plurality of posts are of various lengths to extend out of the club head face at varying distances.

10. A golf club head, comprising:

a club head body; and a club head face associated with a front portion of the club head body, wherein the club head face includes in the central, ball-striking portion thereof a plurality of cavities extending partially into the club head body, with each of the cavities terminating within the club head body;

wherein the club head face includes in the central, ball-striking portion thereof a plurality of protrusion posts and each of the plurality of protrusion posts includes a post body having a post base and a post head, wherein the plurality of protrusion posts is associated with the club head face to extend away from the surface of the club head face such that the post base of each of the plurality posts is associated with separate cavities of the plurality of cavities, the plurality of protrusion posts being of various lengths and extend out of the club head face at varying distances, the plurality of protrusion posts being spaced sufficiently close to each other to make contact with and impact a golf ball when the central portion of the club face strikes the ball.

11. The golf club head of claim 10, wherein the plurality of protrusion posts are integrally formed with the club head face.

12. The golf club head of claim 10, wherein the plurality of protrusion posts are removably associated with the club head face via at least one of a threaded connection, an epoxy and a friction/snap fit connection.

13. The golf club head of claim 12, wherein the protrusions protrusion posts include a protrusion base and a protrusion head and wherein the protrusion base includes a base width BW and the post head includes a head width HW and wherein the base width BW and the head width HW are substantially equal.

14. The golf club head of claim 12, wherein the protrusion head is configured in at least one of a round shape, square shape, a single pointed shape, a multi-pointed shape, a wedge shape, a star shape and a triangular shape.

15. The golf club head of claim 10, further comprising at least one sensing device associated with at least one of the plurality of protrusion posts.

16. A golf club head, comprising:

a club head body; and a club head face associated with a front portion of the club head body, wherein the club head face includes in the central, ball-striking portion thereof a plurality of cavities extending partially into the club head body, with each of the cavities terminating within the club head body;

wherein the club head face includes in the central, ball-striking portion thereof a plurality of protrusion posts and each of the plurality of protrusion posts includes a post body having a post base and a post head, wherein the plurality of protrusion posts is associated with the club head face to extend away from the surface of the club head face such that the post base of each of the plurality posts is associated with separate cavities of the plurality of cavities, at least one sensing device being associated with at least one of the plurality of protrusion posts, the plurality of protrusion posts being spaced sufficiently close to each other to make contact with and impact a golf ball when the central portion of the club face strikes the ball.

* * * * *